US006025798A

United States Patent [19]

Colombel et al.

[11] Patent Number: 6,025,798

[45] Date of Patent: Feb. 15, 2000

[54] CROSSED POLARIZATION DIRECTIONAL ANTENNA SYSTEM

[75] Inventors: Franck Colombel, Port Blanc; Eric Deblonde, Mantallot; Patrick Le Cam, Ploubezre; Fabien Peleau, Perros Guirec, all of France

[73] Assignee: Alcatel, Paris, France

[21] Appl. No.: 09/121,855

[22] Filed: Jul. 24, 1998

[30] Foreign Application Priority Data

Jul. 28, 1997 [FR] France ..... 97 09566

[51] Int. Cl.[7] ..... H01Q 21/06; H01Q 9/28

[52] U.S. Cl. ..... 342/361; 343/795; 343/809; 343/815

[58] Field of Search ..... 343/793, 797, 343/808, 806, 807, 809, 810, 814, 815, 794, 795; 342/361; 455/269, 279

[56] References Cited

U.S. PATENT DOCUMENTS

| | | | |
|---|---|---|---|
| 3,605,102 | 9/1971 | Frye . | |
| 4,062,019 | 12/1977 | Woodward et al. | 343/797 |
| 5,039,994 | 8/1991 | Wash et al. | 343/813 |
| 5,280,297 | 1/1994 | Profera, Jr. | 343/754 |
| 5,434,575 | 7/1995 | Jelinek et al. . | |

FOREIGN PATENT DOCUMENTS

| | | |
|---|---|---|
| 0178877 | 4/1986 | European Pat. Off. . |
| WO9722159 | 6/1997 | WIPO . |

*Primary Examiner*—Gregory C. Issing
*Attorney, Agent, or Firm*—Sughrue, Mion, Zinn, Macpeak & Seas, PLLC

[57] ABSTRACT

A crossed polarization antenna system including a substantially flat and rectangular reflector and at least one radiating cell carried by the reflector, each cell including at least two first conductor elements assembled tail-to-tail and energized by a first external power supply forming a first dipole. Each radiating cell includes two second conductor elements mounted in exactly the same way as the first elements and energized by a second external power supply forming a second dipole. The conductor elements are V-shape bent elements with the second elements mounted orthogonally to the first elements. Applications include mobile telephones.

15 Claims, 2 Drawing Sheets

CROSSED POLARIZATION DIRECTIONAL ANTENNA SYSTEM

BACKGROUND OF THE INVENTION

1. Field of the Invention

The present invention concerns a crossed polarization directional antenna system intended in particular for cellular telephones.

2. Description of the Prior Art

Document U.S. Pat. No. 5,710,569 describes a directional antenna system including a flat reflector and an array of antennas carried by the reflector. Each antenna is a dipole defined by two straight conductor members mounted on two supports for fixing them to the reflector and is connected to the + and − terminals of a power supply. The antennas of the array are aligned with one axis of the reflector. They are of single polarization within the array.

Document U.S. Pat. No. 5,030,962 describes a crossed polarization directional antenna structure including a substrate of high electrical resistivity, in particular of silicon, an array of antennas formed on the substrate and a dielectric lens associated with the system. Each antenna comprises two dipoles and four diodes interconnecting the dipoles in pairs. The diodes are connected in a loop and therefore connect the four branches of the two dipoles, two opposite diodes in the loop being of opposite polarity to the other two.

In the above antenna structure the passive components defined by the dipoles and the active components such as the diodes and possible other components associated with the dipoles are fabricated by multilayer photo-etching on the substrate.

In particular, the branches of the dipoles are each in the form of a straight and narrow conductive strip or a triangular conductive plate and are opposed in pairs, the respective axes of the two dipoles being orthogonal.

These double polarization antennas of the prior art are designed for radar applications and operate at very high frequencies, in the order of 100 GHz. They are not suitable for mobile telephone applications, for which antennas must be particularly robust mechanically and transmit in a wide band around a predefined frequency less than the frequencies of the previously cited prior art structure, for example around 915 MHz for GSM transmission, 1,780 MHz for DCS transmission or 1,920 MHz for PCS transmission.

The aim of the present invention is to provide a compact crossed polarization directional antenna system suitable for mobile telephones.

SUMMARY OF THE INVENTION

The present invention consists in a crossed polarization antenna system including a substantially flat and rectangular reflector and at least one radiating cell carried by the reflector, each cell including at least two first conductor elements assembled tail-to-tail and energized by a first external energy source forming a first dipole, wherein each radiating cell includes two second conductor elements mounted in exactly the same way as the first elements and energized by a second external energy source forming a second dipole and the conductor elements are V-shape bent elements with the second elements mounted orthogonally to the first elements.

The above antenna system preferably has at least one of the following additional features:

each conductor element is a plate bent to a V-shape;

the V-shape conductor elements each have an angle in the range 20° to 80°, preferably in the range approximately 40° to approximately 50°;

the V-shaped conductor elements have an angular orientation other than zero to the horizontal so that they have a polarization direction offset at an angle to the horizontal;

the polarization direction is approximately +45° and approximately −45° for the conductor elements of both dipoles, respectively;

each conductor element has a conductive lug attached to the base of the V-shape and projecting from one side of the V-shape a distance substantially equal to one-quarter the wavelength radiated by the corresponding dipole and fixed to said reflector; it advantageously includes a conductive part for fixing the lugs of the conductor elements of the same cell to the reflector, said lugs having their ends inserted in said fixing part and welded to the latter; also, it can include a fixing part made of a material with a high electrical resistivity fastening the conductor elements of the same cell together;

an array of cells is disposed along the longitudinal axis of the reflector;

two main cables are respectively connected to two coaxial connectors at one end of the reflector and allocated to said first and second sources and respectively connected to two power splitters respectively connected to first and second cables allocated to energizing the two dipoles of the various cells;

the reflector carries extrusions mounted parallel to the longitudinal axis and symmetrically on respective opposite sides of the array of cells to form a coupling compensator.

The features and advantages of the present invention will emerge from the following description of one preferred embodiment shown in the accompanying drawings. In the drawings:

DETAILED DESCRIPTION OF THE PREFERRED EMBODIMENTS

Figure 1:
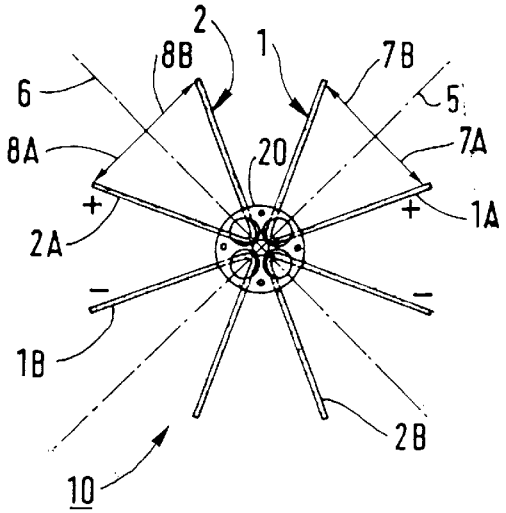
FIG. 1 is a front view of one double polarization directional antenna cell of the invention.
Figure 2:
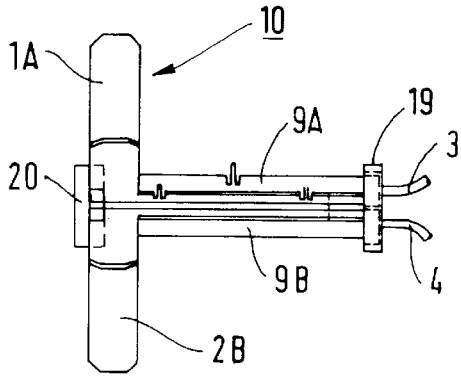
FIG. 2 is a side view of the cell from FIG. 1.

Referring to FIG. 1 and/or FIG. 2, the radiating cell of the invention includes two crossed polarization directional antennas 1 and 2.

Each of the two antennas constitutes a dipole formed by a pair of V-shape conductor elements 1A and 1B or 2A and 2B depending on the dipole referred to.

The two conductor elements of the same dipole are assembled tail-to-tail. The two conductor elements of one of the two dipoles are orthogonal to those of the other one. The conductor elements of the dipole 1 are connected to a coaxial cable 3 for energizing them from a first external power supply. The conductor elements of the dipole 2 are similarly connected to another coaxial cable 4 to energize them from a second external power supply independent of the first one. The polarities of the dipoles are denoted + and – respectively alongside the two conductor elements of each of them.

FIG. 1 shows the crossed polarization directions 5 and 6 of the radiating cell, which correspond to the bisectors of the conductor elements of both the dipoles 1 and 2 and are the result of currents in those elements. The crossed polarization directions 5 and 6 are the main components of polarization contained by the energized dipoles 1 and 2. They are in phase for the two conductor elements of the same dipole.

The two secondary components 7A–7B and 8A–8B orthogonal to the main polarization components are also shown. These secondary components are in phase opposition in each conductor element of the dipoles.

The advantage of the V-shape of each conductor element of the dipoles is that it minimizes the distant effect of these orthogonal components which tend to cancel out in pairs. For dipoles with conductor elements formed by two plates or layers having the shape of a solid V, the distant effect of the orthogonal components remains high. In a dipole of this kind the current lines diverge near the edges of each solid V to follow these edges so that the orthogonal components are no longer in phase opposition.

The V-shape conductor elements of the two dipoles are preferably plates folded to a V-shape. This embodiment using plates and not wire type electrical conductors increases the bandwidth of the dipoles.

The angle of the V-shape of each conductor element is preferably in the range 20° to 80°. To optimize the impedance of the antennas it is advantageously in the range approximately 40° to approximately 50°.

To optimize the transmission characteristics of the two dipoles the orientation of the Vs to the horizontal or the vertical is advantageously chosen so that neither of the polarization directions 5 and 6 is horizontal. In particular the Vs are oriented so that the polarization directions 4 and 5 are respectively at +45° and –45° to the vertical.

Referring to FIG. 2, it can be seen that the V-shape conductor elements each include the two branches of each V but also a lug 9A or 9B transverse to the V and upstanding from the base of the latter.

The two branches of the V and the lug are in one piece, the lug being bent at the same time as the branches.

In the crossed polarization antenna cell the length of each dipole is substantially equal to half the wavelength of the radiated energy. The length of the lugs 9A or 9B are substantially equal to one-quarter the wavelength and these lugs render the current symmetrical to impart the + and – polarities to the two elements of the same energized dipole. The electrical power supplied by the power supply connected to one of the dipoles is therefore converted to radio waves radiated by the dipole in accordance with a required wideband diagram.

Figure 3:
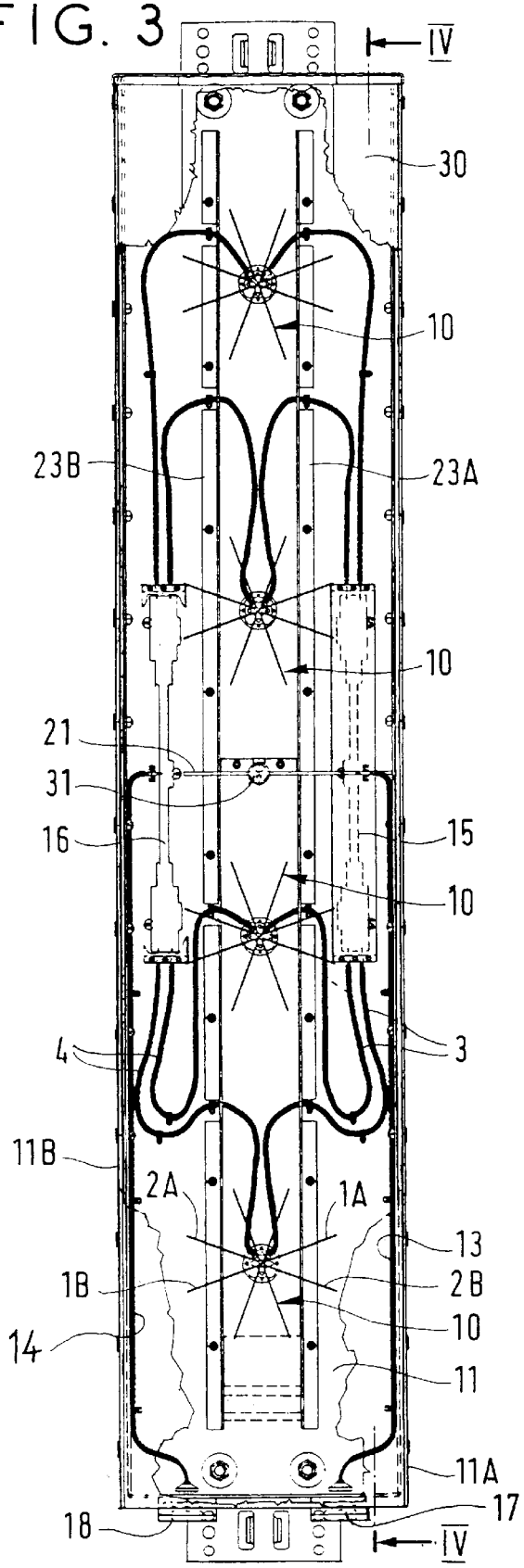
FIG. 3 is a front view of an antenna array system of the invention.
Figure 4:
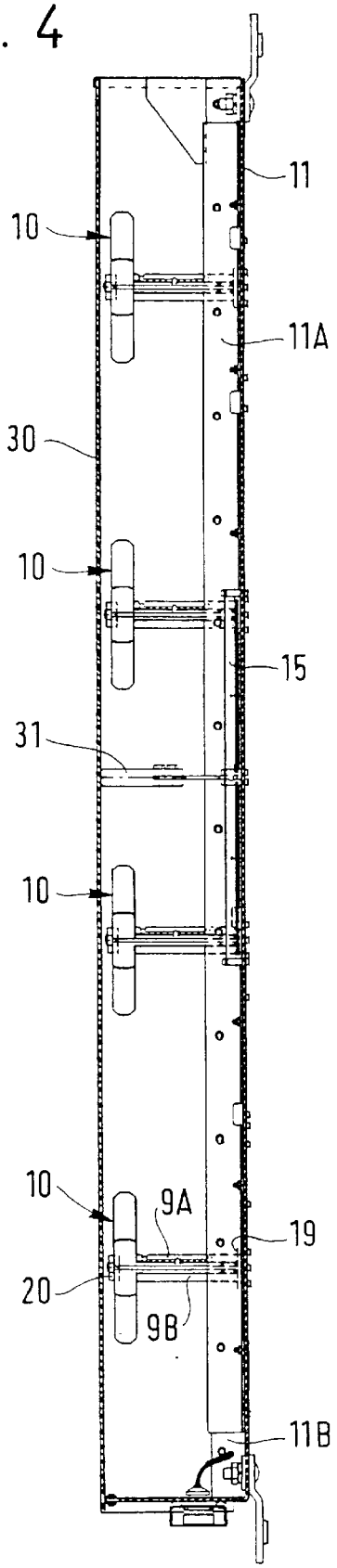
FIG. 4 is a view in section taken along the line IV—IV in FIG. 3.

The antenna system shown in FIG. 3 and/or FIG. 4 includes an array of double polarization antennas which are identical to each other and to the cell from FIG. 1 and they are all designated by the same global reference number 10, also used in FIGS. 1 and 2. This array of antennas or radiating cells 10 is carried by a rectangular flat reflector 11. It is disposed along the longitudinal axis of the reflector. It includes four cells in the example shown. Each cell is energized via two cables 3 and 4 connected to the two dipoles of the cell. The width of the reflector is close to the wavelength of the energy radiated by the antennas. For energizing the dipoles of the various cells the cables 3 of the various cells are connected to a main cable 13 via a power splitter 15 and similarly the cables 4 are connected to another main cable 14 via a second power splitter 16. The two main cables 13 and 14 are connected to two coaxial connectors 17 and 18 carried by one end of the reflector and provided for the two power supplies allocated to the dipoles of the various cells 10.

Referring in particular to FIGS. 1, 2 and 4, each cell 10 is fixed to the reflector by means of a conductive part 19 at the end of the lugs 9A and 9B of the two dipoles and itself fixed to the reflector.

The part 19 is circular and relatively flat. It has four holes in one face into which are inserted and welded the ends of the four lugs 9A and 9B and is screwed to the reflector.

The V-shape conductor members with their individual lug and the fixing part 19 are made of brass.

Referring to FIGS. 1 to 3, another part 20 having a high electrical resistivity, for example made of plastics material, is advantageously mounted between the four conductor elements of the same dipole to strengthen their fixing to each other. The part 20 is also used to fix the two coaxial cables 3 and 4, the central conductor of each of which is soldered to one of the conductor elements. This strengthening part incorporated apertures to minimize its influence in the cell 10 concerned.

The crossed polarization antenna system also has at least one metal separator wall such as the wall 21 between the cells or groups of cells of the array. The single wall 21 used in the antenna system of FIGS. 3 and 4 runs along the transverse axis of the reflector 11. It is fixed to and projects from the reflector. It prevents direct coupling between radiating elements on its respective opposite side.

In accordance with the invention, the antenna system is further equipped with a compensator for airborne indirect coupling between the dipoles, this indirect coupling resulting largely from coupling between the electric fields caused by unwanted reflections at the reflector and more particularly at its usually bent longitudinal edges 11A and 11B.

The coupling compensator comprises two extrusions or angle-irons 23A, 23B. These angle-irons are mounted on the rectangular flat reflector parallel to the longitudinal edges and symmetrically on respective opposite sides of the longitudinal axis along which the four cells are aligned.

The two angle-irons offer additional reflective surfaces with respect to the edges, so that the recombination of the electric fields reflected by the edges and by the angle-irons significantly reduces coupling between the two orthogonal polarizations of the antenna system.

Figure 5:
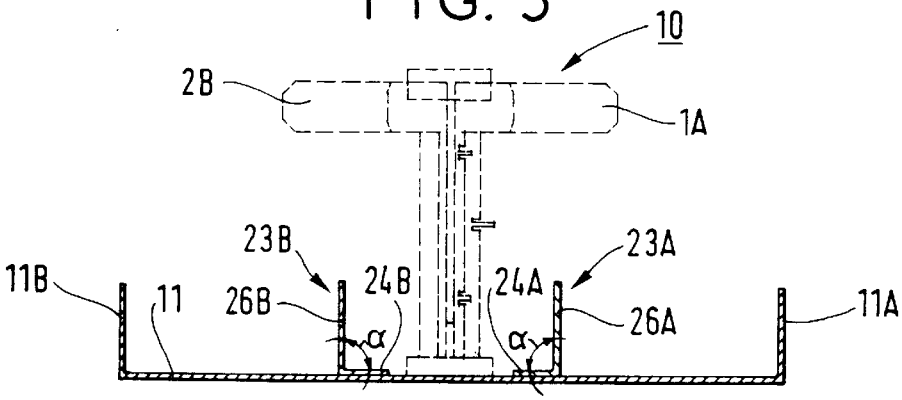
FIG. 5 is a simplified view in section of the antenna array from FIG. 3 showing two angle-irons in a first embodiment.

In a first embodiment of the invention, FIG. 5, each angle-iron 23A or 23B has a base 24A or 24B fixed to the reflector 11 and a crest 26A or 26B bent through an angle less than 180° to the base, for example a right angle. The various dimensions of the antenna system represented in FIG. 5 are, for example, in millimeters (mm):

| | |
|---|---|
| width of reflector | 250 mm |
| height of each edge | 32 mm |

-continued

| | |
|---|---|
| crest height of each angle-iron | 35 mm |
| distance from crest to nearest edge | 84 mm |

Figure 6:
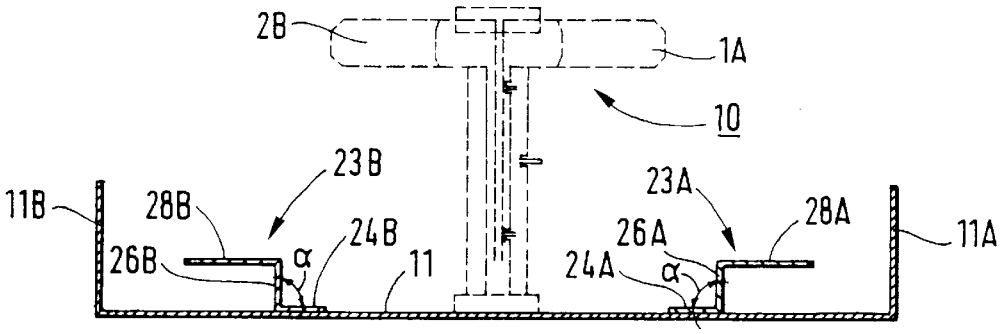
FIG. 6 is a simplified view in section of the antenna array from FIG. 3 showing two angle-irons in a second embodiment.

In a second embodiment of the invention, FIG. 6, each angle-iron 23A or 26B comprises a lip 28A or 28B bent relative to the edge, for example at a right angle, towards the corresponding longitudinal edge 11A or 11B. The various dimension of the antenna system represented in FIG. 6 are, for example:

| | |
|---|---|
| width of reflector | 300 mm |
| height of each edge | 48 mm |
| crest height of each angle-iron | 20 mm |
| distance from crest to nearest edge | 128 mm |
| width of lip | 37 mm |

Both the above examples of the antenna system have a passband from 872 MHz to 960 MHz, centered on 915 MHz. To determine experimentally the coupling between the two orthogonal polarizations of the antenna system electromagnetic power was fed by a power supply to the dipoles 1A–1B of four identical cells 10 the polarization of which was at an angle of +45° to the longitudinal edge 11A. The dipoles 2A–2B of the cells 10 the polarization of which was at an angle of −45° to the longitudinal edge 11B detect power to coupling which in the presence of the two angle-irons described in the preceding two examples is in the order of one thousandth of the power output by the supply, whereas in the absence of the angle-irons it is in the order of one hundredth of this power. The two angle-irons therefore reduce coupling between the two crossed polarizations of the antenna system by a factor of 10, from 20 decibels (dB) to 30 dB.

In a variant that is not shown the compensator can comprise on each side of the four cells a plurality of angle-irons like those mentioned above or an extrusion with a plurality of crests like those of the angle-irons mentioned above.

The structure of the antenna system of the invention is completed by a radome 30 fixed to the rims of the reflector 11 and shown in FIGS. 3 and 4. A support part 31 is fixed to the central part of the metal wall 21 to increase the mechanical strength of the radome.

There is claimed:

1. A crossed polarization antenna system including a substantially flat and rectangular reflector and at least one radiating cell carried by said reflector, each cell including at least two first conductor elements assembled tail-to-tail and energized by a first external power supply forming a first dipole, wherein each radiating cell includes two second conductor elements mounted in exactly the same way as said first elements and energized by a second external power supply forming a second dipole and said conductor elements are V-shape bent elements with said second elements mounted orthogonally to said first elements.

2. The system claimed in claim 1 wherein each conductor element is a plate bent to a V-shape.

3. The system claimed in claim 1 wherein said V-shape conductor elements each have an angle in the range 20° to 80°.

4. The system claimed in claim 3 wherein said angle is chosen in the range approximately 40° to approximately 50°.

5. The system claimed in claim 1 wherein said V-shaped conductor elements have an angular orientation other than zero to the horizontal so that they have a polarization direction offset at an angle to the horizontal.

6. The system claimed in claim 5 wherein said polarization direction is approximately +45° and approximately −45° for said conductor elements of both dipoles, respectively.

7. The system claimed in claim 1 wherein each conductor element has a conductive lug attached to the base of said V-shape and projecting from one side of said V-shape a distance substantially equal to one-quarter the wavelength radiated by the corresponding dipole and fixed to said reflector.

8. A system as claimed in claim 7 including a conductive part for fixing said lugs of said conductor elements of the same cell to said reflector, said lugs having their ends inserted in said fixing part and welded to the latter.

9. A system as claimed in claim 7 including an attachment part made from material of high electrical resistivity fastening together said conductor elements of the same cell.

10. A system as claimed in claim 1 including an array of cells disposed along the longitudinal axis of said reflector.

11. A system as claimed in claim 1 including two main cables respectively connected to two coaxial connectors at one end of said reflector and allocated to said first and second power supplies and respectively connected to two power splitters respectively connected to first and second cables allocated to energizing said two dipoles of the various cells.

12. A system as claimed in claim 10 wherein said reflector has two longitudinal edges and extrusions mounted parallel to the longitudinal axis and symmetrically on respective opposite sides of the array of cells.

13. The system claimed in claim 12 wherein each extrusion comprises a base fixed to said reflector and at least one crest bent at an angle less than 180° relative to the base.

14. The system claimed in claim 13 wherein each extrusion comprises a lip bent relative to said crest towards a longitudinal edge.

15. The system claimed in claim 1 wherein said first and second conductor elements are substantially parallel to said reflector.

* * * * *